US009752231B2

(12) United States Patent
Li

(10) Patent No.: US 9,752,231 B2
(45) Date of Patent: Sep. 5, 2017

(54) APPARATUS FOR ELECTROLESS METAL DEPOSITION HAVING FILTER SYSTEM AND ASSOCIATED OXYGEN SOURCE

(75) Inventor: Shijian Li, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 1206 days.

(21) Appl. No.: 13/469,607

(22) Filed: May 11, 2012

(65) Prior Publication Data

US 2013/0302527 A1 Nov. 14, 2013

(51) Int. Cl.
*C23C 18/16* (2006.01)

(52) U.S. Cl.
CPC ..... *C23C 18/1617* (2013.01); *C23C 18/1683* (2013.01)

(58) Field of Classification Search
CPC ..... C23C 18/1619; H01L 21/76873; C25D 17/04; B05C 9/12; B05C 3/09; B05C 3/109
USPC ..... 427/436, 437, 443.1; 438/678; 118/429
See application file for complete search history.

(56) References Cited

U.S. PATENT DOCUMENTS 5,241,979 A * 9/1993 Chang ..... B01D 29/03 137/247.41
6,113,769 A * 9/2000 Uzoh ..... C25D 21/14 204/237
6,846,519 B2 1/2005 Ivanov et al.
6,913,651 B2 7/2005 Ivanov et al.
7,465,358 B2 12/2008 Weidman et al.
7,690,324 B1 * 4/2010 Feng ..... C23C 18/1619 118/423
7,845,308 B1 12/2010 Corneille et al.
8,069,813 B2 12/2011 Thie et al.
8,257,781 B1 * 9/2012 Webb ..... C23C 18/1617 427/97.9
8,539,907 B2 * 9/2013 Hsu ..... B05C 3/18 118/400
8,622,020 B2 * 1/2014 Thie ..... C23C 18/1617 118/409
8,911,552 B2 * 12/2014 Jacobson ..... 118/603
2003/0232148 A1 * 12/2003 Shahin ..... C23C 18/36 427/438
2009/0141583 A1 * 6/2009 Fanjat ..... G05D 11/133 366/140
2010/0024886 A1 * 2/2010 Seth ..... D21H 1/16 137/1
2014/0287540 A1 * 9/2014 Ahn ..... C23C 18/1204 438/7

* cited by examiner

*Primary Examiner* — Karl Kurple
(74) *Attorney, Agent, or Firm* — Beyer Law Group LLP

(57) ABSTRACT

One or more aspects of this invention pertain to fabrication of electronic devices. One aspect of the present invention is a system for electroless deposition of metal on a substrate. According to one or more embodiments of the present invention, the system comprises a main subsystem in combination with one or more subsystems for electroless deposition on a substrate. Another aspect of the present invention is a method of making an electronic device. According to one or more embodiments of the present invention, the method comprises one or more processes. Descriptions according to one or more embodiments of the system and the processes are presented.

4 Claims, 4 Drawing Sheets

APPARATUS FOR ELECTROLESS METAL DEPOSITION HAVING FILTER SYSTEM AND ASSOCIATED OXYGEN SOURCE

BACKGROUND

One or more embodiments of the present invention pertain to fabrication of electronic devices such as integrated circuits; more specifically, one or more embodiments of the present invention relate to systems, apparatuses, and methods for electroless deposition (ELD) of metals such as metallization layers.

Electroless deposition is frequently used in the fabrication of electronic devices. The process is important for applications requiring deposition of metal on substrates for layers to form integrated circuits. Electroless deposition processes can readily proceed on certain activated and/or catalytic surfaces such as metal, metal alloy, or other electrically conductive surfaces.

As such, electroless deposition solutions may be or may become unstable solutions if the properties of the solution or the conditions of use of the electroless deposition solutions change. Although the usual intention of electroless deposition is to achieve metal or metal alloy deposition exclusively on the substrate, electroless deposition of the metal or the metal alloy can occur in places other than on the substrate such as on metal particles, semi-conductive particles, and/or imperfections in the deposition system chamber walls. Consequently, plating other than on the substrate is often to be expected.

Electroless deposition systems that recycle at least a portion of the electroless deposition solution may dislodge deposited metal particles and carry them anywhere in the recycling system, hence further deposition may occur on these metal particles at any place in the system. For these and/or other reasons, electroless deposition systems are susceptible to a phenomena referred to here as "plating out."Plating out is a catastrophic deposition of the metal other than on the substrate in an electroless deposition chamber. Catastrophic is defined here to mean that either the rate of deposition is rapid and/or the deposition occurs in such a massive amount that metal particles form and accumulate inside the electroless deposition system. Plating out also includes having the metal form particles in the electroless deposition solution. When formed as small metal particles, the particles may be suspended, at least temporarily, in the electroless deposition solution. The metal particles may grow in size so that the metal particles settle in various regions of the electroless deposition system. Previous efforts to avoid the problems of plating out have been unsuccessful.

The present inventor has made one or more developments that may be pertinent to electroless deposition technology such as that for electronic devices. The one or more developments may have the potential to alleviate problems such as plating out for one or more electroless deposition processes.

SUMMARY

One or more aspects of this invention pertain to fabrication of electronic devices. One aspect of the present invention is a system for electroless deposition of metal on a substrate. According to one or more embodiments of the present invention, the system comprises a main subsystem in combination with one or more subsystems for applications such as electroless deposition on a substrate.

Another aspect of the present invention is a method of making an electronic device that includes electroless deposition. According to one or more embodiments of the present invention, the method comprises one or more processes.

It is to be understood that the invention is not limited in its application to the details of construction and to the arrangements of the components set forth in the following description. The invention is capable of other embodiments and of being practiced and carried out in various ways. In addition, it is to be understood that the phraseology and terminology employed herein are for the purpose of description and should not be regarded as limiting.

BRIEF DESCRIPTION OF THE DRAWINGS

FIG. 3-1 is a diagram of a system according to an embodiment of the present invention.

Figure 1:
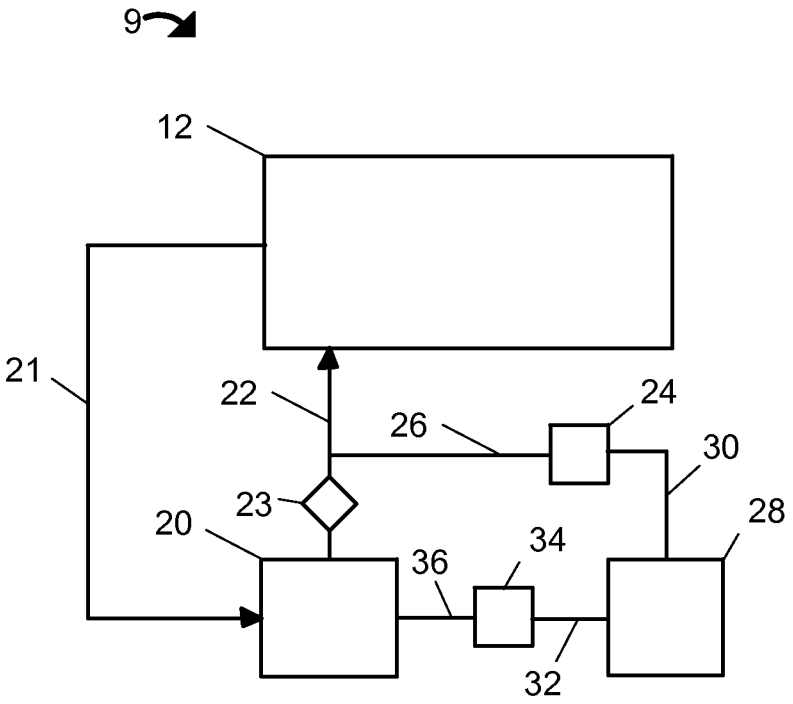
FIG. 1 is a diagram of a system according to an embodiment of the present invention.

Skilled artisans appreciate that elements in the figures are illustrated for simplicity and clarity and have not necessarily been drawn to scale. For example, the dimensions of some of the elements in the figures may be exaggerated relative to other elements to help to improve understanding embodiments of the present invention.

DESCRIPTION

For the following defined terms, these definitions shall be applied, unless a different definition is given in the claims or elsewhere in this specification. All numeric values are herein defined as being modified by the term "about," whether or not explicitly indicated. The term "about" generally refers to a range of numbers that a person of ordinary skill in the art would consider equivalent to the stated value to produce substantially the same properties, function, result, etc. A numerical range indicated by a low value and a high value is defined to include all numbers subsumed within the numerical range and all subranges subsumed within the numerical range. As an example, the range 10 to 15 includes, but is not limited to, 10, 10.1, 10.47, 11, 11.75 to 12.2, 12.5, 13 to 13.8, 14, 14.025, and 15.

The term "metal" is used herein to refer to a metal element in the periodic table of the elements, to metal alloys comprising one or more metal elements mixed with at least one other element, and/or to electrically conductive compounds. The metal elements, the metal alloys, and the electrically conductive compounds have the general properties of metal elements from the periodic table of the elements such as high electrical conductivity.

One or more embodiments of the present invention pertain to methods, systems, and apparatuses to form metallization structures on substrates such as, but not limited to, wafers, disks, plates, blocks, silicon on insulator, semiconductor wafers, silicon wafers, gallium arsenide wafers, and/or wafers of other materials.

Embodiments of the present invention will be discussed below primarily in the context of processing semiconductor wafers such as silicon wafers used for fabricating electronic devices. The electronic devices include one or more electrical conductors such as, but not limited to, cobalt, copper, nickel, cobalt alloys, and nickel alloys. However, it is to be understood that embodiments in accordance with the present invention may be used for other types of semiconductor devices, substrates other than semiconductor wafers, and conductors other than cobalt, copper, nickel, cobalt alloys, and/or nickel alloys. One or more embodiments of the present invention will be discussed below primarily in the context of electroless deposition of cobalt or cobalt alloys.

In the following description of the figures, identical reference numerals have been used when designating substantially identical elements or processes that are common to the figures.

Reference is now made to FIG. 1 where there is shown a diagram of a system 9 according to one embodiment of the present invention. System 9 comprises an electroless deposition chamber 12 to hold a substrate (substrate not shown) for electroless deposition. System 9 comprises a reservoir 20, a reclaim fluid line 21, a feed fluid line 22, and a filter 23. Reservoir 20 is configured to hold an electroless deposition solution. Reservoir 20 is connected with electroless deposition chamber 12 by feed fluid line 22 to provide electroless deposition solution to deposition chamber 12. Filter 23 is coupled into feed fluid line 22 so as to remove particles from the electroless deposition solution before the electroless deposition solution enters electroless deposition chamber 12. Reclaim fluid line 21 is connected between electroless deposition chamber 12 and reservoir 20 to return electroless deposition solution back to reservoir 20 as a reclaim stream.

Also, system 9 comprises a sensor 24 responsive to dissolved oxygen concentration in the electroless deposition solution. Sensor 24 is disposed so as to measure the dissolved oxygen concentration of the electroless deposition solution in feed fluid line 22. The embodiment shown in FIG. 1 includes a sensor line 26 connecting sensor 24 with feed fluid line 22 to measure the dissolved oxygen concentration in the electroless deposition solution. System 9 further comprises a controller 28, a signal line 30, a control line 32, and an oxygen source 34. Controller 28 is connected with oxygen source 34 by way of control line 32 so that controller 28 can provide signals or commands to control the operation of oxygen source 34. Oxygen source 34 is connected with reservoir 20 so as to provide oxygen to reservoir 20. According to one embodiment of the present invention, the connection between oxygen source 34 and reservoir 20 comprises a fluid line 36. Optionally, oxygen source 34 may comprise a connection with an oxygen source. Controller 28 is connected with reservoir 20 by way of control line 32, oxygen source 34, and fluid line 36. Controller 28 is connected with sensor 24 by way of signal line 30. Controller 28 is configured to control the input of oxygen from oxygen source 34 in to reservoir 20 so as to adjust the concentration of dissolved oxygen in the electroless deposition solution in response to signals based on measurements of dissolved oxygen concentration derived by sensor 24 and provided to controller 28.

Optionally, system 9 can be used for electroless deposition processes such as electroless deposition of metals such as, but not limited to, cobalt, cobalt alloys, nickel, nickel alloys, copper, copper alloys, and/or any other transition metals and metal alloys that can be deposited by electroless deposition. According to one or more embodiments of the present invention, sensor 24 is configured to indicate the dissolved oxygen concentrations in the electroless deposition solution so that the oxygen concentrations can be increased if the dissolved oxygen concentration falls below a desired level. According to one or more embodiments of the present invention, the desired level is the level of dissolved oxygen concentration in equilibrium with a gas at one atmosphere pressure that includes 0.5% $O_2$. For one or more embodiments of the present invention, the dissolved oxygen concentration is monitored near the point of use so that the dissolved oxygen concentration is automatically maintained by controller 28 using oxygen source 34. More specifically, controller 28 provides a signal to oxygen source 34 so that oxygen is provided to reservoir 20 to maintain the dissolved oxygen concentration at a level high enough to inhibit plating out of particles of the metal in the electroless deposition solution such as particles of cobalt or particles of cobalt alloy.

In general, the present inventor has recognized that the electroless deposition solutions used in systems susceptible to plating out need to maintain a balance between the formation and dissolution of metal particles present in the electroless deposition solution. More specifically, the electroless deposition solution contains components that make up the electroless deposition solution and also contains particles of the metal and dissolved oxygen. A balance must be maintained between formation and growing of the metal particles and dissolution of the metal particles. The dissolution of the metal particles is promoted by the presence of dissolved oxygen in the electroless deposition solution. The dissolved oxygen oxidizes the surface of the metal particles which causes the metal particles to dissolve in the electroless deposition solution. If the amount of dissolved oxygen is insufficient, then there is additional deposition of metal on the metal particles; the metal particles grow in size and plating out, in some situations, may occur instantaneously. In brief, the presence of oxygen drives the dissolution of the metal particles and the absence of oxygen drives deposition of the metal. This means that the dissolved oxygen concentration can be used to control the rate of dissolution of the metal particles and the rate of deposition of the metal. If the dissolved oxygen concentration is too high in the electroless deposition solution, the process of plating the metal on the substrate becomes more difficult, unpredictable, and may even be impossible.

Because of the relationship between the oxygen and metal particles, the concentration of dissolved oxygen is affected by the metal particles. Specifically, the amount of dissolved oxygen can be reduced by the presence of metal particles in the electroless deposition solution. This further means that the dissolved oxygen can be consumed by the metal particles such that the presence of metal particles without a source for additional oxygen can lead to conditions for plating out.

According to one or more embodiments of the present invention, an optimum concentration for the dissolved oxygen in the electroless deposition solution is the level of dissolved oxygen concentration in equilibrium with a gas at one atmosphere pressure containing 0.5% $O_2$. According to one embodiment of the present invention, the electroless deposition solution is configured for deposition of cobalt and/or cobalt alloys and the optimum dissolved oxygen concentration is equivalent to the level of dissolved oxygen in the electroless deposition solution in equilibrium with a gas mixture at one atmosphere containing 0.5% oxygen. It is to be understood that the optimum oxygen concentration and/or effective oxygen concentrations may be different for different metal plating chemistries and even for different cobalt deposition solutions. In view of the present disclosure, persons of ordinary skill in the art will be able to derive effective and/or optimum concentrations of dissolved oxygen for embodiments of the present invention. Furthermore, effective and/or optimum levels of dissolved oxygen can be derived for other variables such as, but not limited to, plating solution composition, temperature, device technology dimensions (such as 35 nanometer device technology or other), etc. According to one embodiment of the present invention, the optimum dissolved oxygen concentration (at 1 atmosphere) decreases for devices having narrower metal lines and smaller connection spots.

A variety of configurations can be used to keep the concentration of dissolved oxygen in the electroless deposition solution at a predetermined level that corresponds to an effective and/or an optimum amount of oxidizer. As one option, oxygen gas or a gas mixture containing oxygen can be provided to reservoir 20 to increase the dissolved oxygen concentration. Alternatively, an oxidizing agent or mixture of oxidizing agents, such as but not limited to, oxygen containing compounds that can oxidize the metal to be deposited without significantly altering the composition of the electroless deposition solution with other components can be used. A possible source of oxygen for one or more embodiments of the present invention may be compounds such as, but not limited to, hydrogen peroxide and nitrogen oxygen compounds.

According to one or more embodiments of the present invention, system 9 uses controller 28 to maintain a dissolved oxygen concentration in reservoir 20 at greater than or equal to the desired level, while keeping the desired oxygen concentration in the electroless deposition solution in delivery line 22 at the desired level. As an option for one or more embodiments of the present invention, the electroless deposition solution comprises cobalt ions and controller 28 maintains a dissolved oxygen concentration in the electroless deposition solution to the level in equilibrium with 0.5% of oxygen gas in a gas mixture above the deposition solution kept at one atmosphere.

Figure 2:
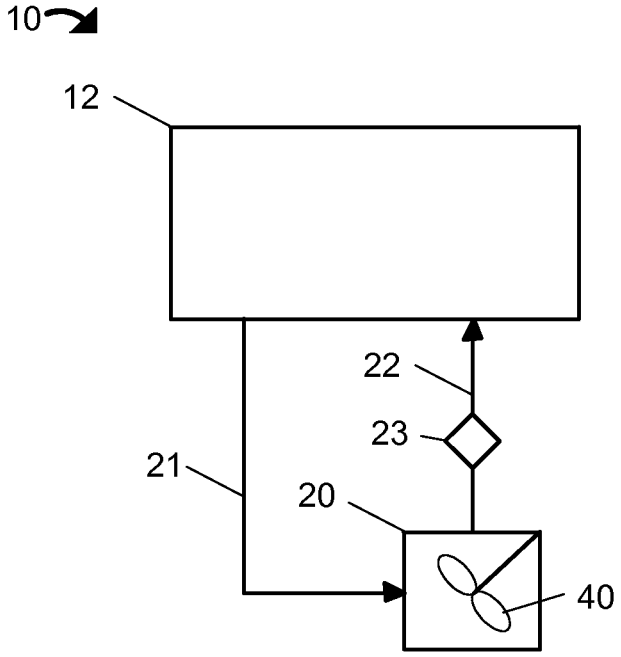
FIG. 2 is a diagram of a system according to an embodiment of the present invention.

Reference is now made to FIG. 2 where there is shown a diagram of a system 10 according to an embodiment of the present invention for electroless deposition of metal on a substrate. According to one embodiment of the present invention, system 10 comprises an electroless deposition chamber 12 to hold a substrate (substrate not shown) for electroless deposition. System 10 comprises a reservoir 20, a reclaim fluid line 21, a feed fluid line 22, and a filter 23. Reservoir 20 is configured to hold an electroless deposition solution. Reservoir 20 is connected with electroless deposition chamber 12 by feed fluid line 22 to provide electroless deposition solution to deposition chamber 12. Filter 23 is coupled into feed fluid line 22 so as to remove particles from the electroless deposition solution before the electroless deposition solution enters electroless deposition chamber 12. Reclaim fluid line 21 is connected between electroless deposition chamber 12 and reservoir 20 to return electroless deposition solution back to reservoir 20 as a reclaim stream.

System 10 further comprises an agitator 40 coupled with reservoir 20. Agitator 40 is configured to provide a substantially even concentration distribution of components that make up the electroless deposition solution in reservoir 20. More specifically, agitator 40 is configured to accomplish mixing of the electroless deposition solution so that the dissolved oxygen concentration in the electroless deposition solution is uniform and avoids having a lower oxygen concentration at the bottom of reservoir 20 that could occur due to the consumption of dissolved oxygen by particles of the metal that my accumulate at the bottom of reservoir 20.

Agitator 40 may be incorporated into one or more embodiments of the present invention in a variety of configurations. According to one embodiment of the present invention, agitator 40 comprises a stirring mechanism such as a paddle or combination of paddles configured for rotational motion to stir the electroless deposition solution and/or configured for back-and-forth motion to stir the electroless deposition solution sufficiently to keep the electroless deposition solution mixed so as to substantially eliminate dissolved oxygen concentration gradients in the electroless deposition solution contained in reservoir 20.

As an example embodiment of the present invention for electroless deposition of cobalt or cobalt alloys, agitator 40 is configured to provide sufficient mixing of the electroless deposition solution so that the oxygen concentration throughout the electroless deposition solution present in reservoir 20 is uniform and at the concentration level ready to be delivered to the deposition chamber. According to one or more embodiments of the present invention, agitator 40 prevents the electroless deposition solution from stagnation that can lead to low dissolved oxygen concentrations at the bottom of reservoir 20 and plating out of particles of the metal such as cobalt particles or cobalt alloy particles.

As an option for another embodiment of the present invention, a system substantially the same as the system presented in FIG. 1 may further include an agitator such as agitator 40 presented in FIG. 2. This configuration would be capable of accomplishing enhanced mixing of the electroless deposition solution in the reservoir in addition to automatic control of the dissolved oxygen concentration in the electroless deposition solution.

Figure 3:
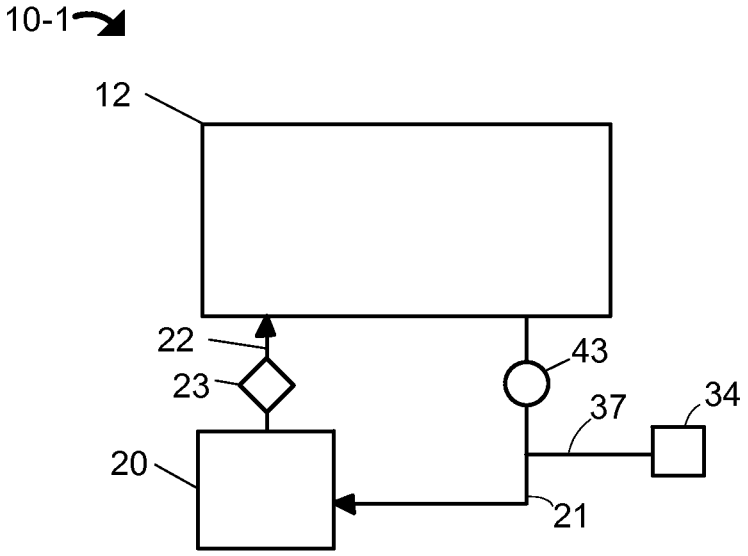
FIG. 3 is a diagram of a system according to an embodiment of the present invention.
Figures 1, 3:
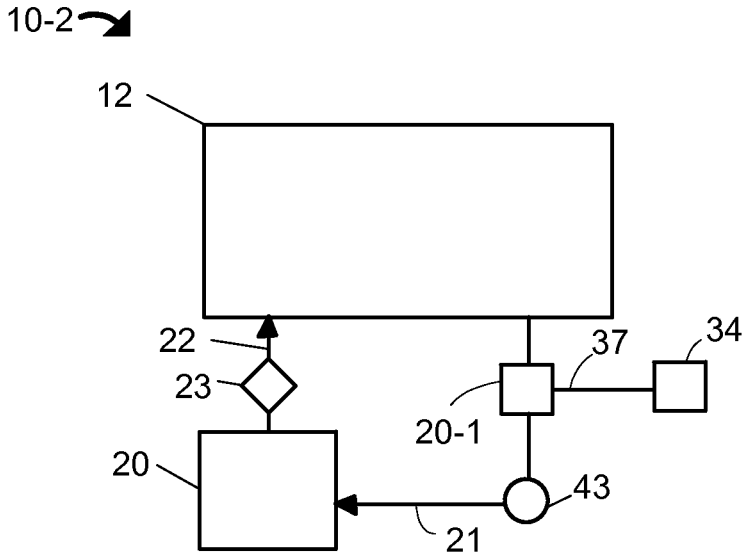

Reference is now made to FIG. 3 where there is shown a diagram of a system 10-1 according to an embodiment of the present invention for electroless deposition of metal on a substrate. According to one embodiment of the present invention, system 10-1 comprises an electroless deposition chamber 12 to hold a substrate (substrate not shown) for electroless deposition. System 10-1 comprises a reservoir 20, a reclaim fluid line 21, a feed fluid line 22, a filter 23, and a pump 43. Filter 23 is coupled into feed fluid line 22 so as to remove particles from the electroless deposition solution before the electroless deposition solution enters electroless deposition chamber 12. Pump 43 is coupled into reclaim fluid line 21 so as to pump liquids from electroless deposition chamber 12 to reservoir 20. Reservoir 20 is configured to hold an electroless deposition solution. Reservoir 20 is connected with electroless deposition chamber 12 by feed fluid line 22 to provide electroless deposition solution to deposition chamber 12. Reclaim fluid line 21 is connected between electroless deposition chamber 12 and reservoir 20 to return electroless deposition solution back to reservoir 20 as a reclaim stream.

System 10-1 further comprises an oxygen source 34 and a fluid line 37 connecting oxygen source 34 to reclaim fluid line 21. Oxygen source 34 is connected with reclaim fluid line 21 to provide oxygen to electroless deposition solution that flows through reclaim fluid line 21 so as to increase the dissolved oxygen concentration locally to dissolved metal particles present in the electroless deposition solution and/or to inhibit plating out of metal. In other words, oxygen source 34 is used to oxygenate the electroless deposition solution that flows from electroless deposition chamber 12 back to reservoir 20.

Optionally, oxygen source 34 may comprise a connection with an oxygen source. Optionally, system 10-1 may further comprise one or more valves (valves not shown in FIG. 3) to regulate the flow of oxygen from oxygen source 34 into reclaim fluid line 21. According to one embodiment of the present invention, system 10-1 further comprises a valve (valve not shown in FIG. 3) connected between reclaim fluid line 21 and oxygen source 34.

According to another embodiment of the present invention, system 10-1 further comprises a valve (valve not shown in FIG. 3) that functions as a check valve connected between reclaim fluid line 21 and oxygen source 34. A check valve is typically configured to allow flow in substantially only one direction. According to this configuration, oxygen source 34 is maintained at a pressure below the pressure in electroless deposition chamber 12 and below the pressure in reservoir 20 so that flow from the oxygen source is constrained from source 34 to both reservoir 20 and chamber 12.

Reference is now made to FIG. 3-1 where there is shown a diagram of a system 10-2 according to an embodiment of the present invention for electroless deposition of metal on a substrate. According to one embodiment of the present invention, system 10-2 comprises an electroless deposition chamber 12 to hold a substrate (substrate not shown) for electroless deposition. System 10-2 comprises a reservoir 20, a tank 20-1, a reclaim fluid line 21, a feed fluid line 22, a filter 23, and a pump 43. Filter 23 is coupled into feed fluid line 22 so as to remove particles from the electroless deposition solution before the electroless deposition solution enters electroless deposition chamber 12. Tank 20-1 is configured to hold electroless deposition solution. Tank 20-1 is coupled into reclaim fluid line 21 to receive electroless deposition solution from electroless deposition chamber 12. Pump 43 is coupled into reclaim fluid line 21 so as to pump liquids from electroless deposition chamber 12 by way of tank 20-1 to reservoir 20. Reservoir 20 is configured to hold electroless deposition solution. Reservoir 20 is connected with electroless deposition chamber 12 by feed fluid line 22 to provide electroless deposition solution to deposition chamber 12.

Reclaim fluid line 21 is connected between electroless deposition chamber 12 and reservoir 20 to return electroless deposition solution back to reservoir 20 as a reclaim stream.

System 10-2 further comprises an oxygen source 34 and a fluid line 37 connecting oxygen source 34 to tank 20-1. Oxygen source 34 is connected with tank 20-1 to provide oxygen to electroless deposition solution in tank 20-1 so as to increase the dissolved oxygen concentration so as to dissolve metal particles present in the electroless deposition solution and/or to inhibit plating out of metal. In other words, oxygen source 34 is used to oxygenate the electroless deposition solution that flows from electroless deposition chamber 12 back to reservoir 20.

Optionally, oxygen source 34 may comprise a connection with an oxygen source. Optionally, system 10-2 may further comprise one or more valves (valves not shown in FIG. 3-1) to regulate the flow of oxygen from oxygen source 34 into tank 20-1. According to one embodiment of the present invention, system 10-2 further comprises a valve (valve not shown in FIG. 3-1) connected between tank 20-1 and oxygen source 34.

According to another embodiment of the present invention, tank 20-1 is configured to hold reclaimed electroless deposition solution in contact with a gas comprising oxygen present at a level to provide dissolved oxygen sufficient so that metal particles present in the electroless deposition solution dissolve. For one or more embodiments, the residence time for the reclaim electroless deposition solution in tank 20-1 is sufficiently long so that the dissolution of the metal particles is completed or near completion before the reclaimed electroless deposition exits tank 20-1.

According to another embodiment of the present invention, system 10-2 further comprises a filter or a filter system coupled into the reclaim line at a position after the tank. More, specifically the filter or filter system may be used to filter electroless deposition solution from tank 20-1.

Figure 4:
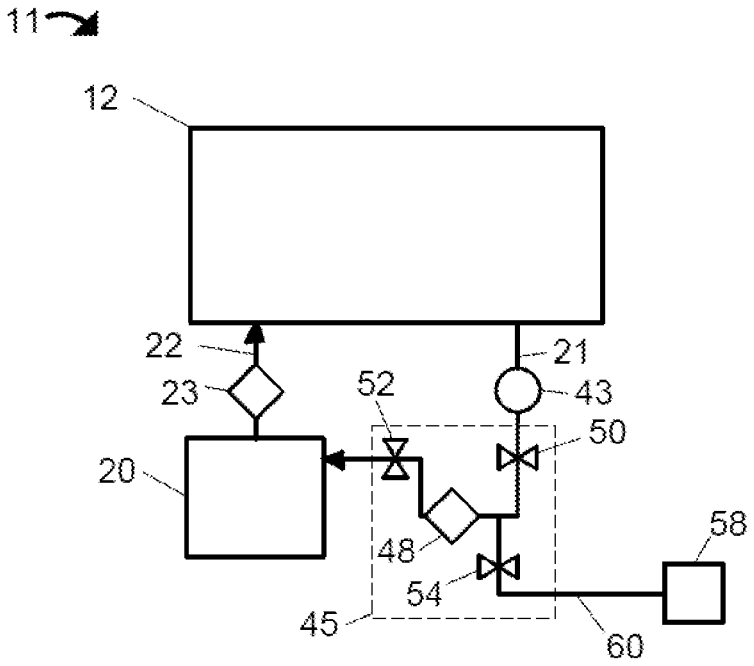
FIG. 4 is a diagram of a system according to an embodiment of the present invention.

Reference is now made to FIG. 4 where there is shown a diagram of a system 11 according to one embodiment of the present invention. System 11 comprises an electroless deposition chamber 12 to hold a substrate (substrate not shown) for electroless deposition. System 11 comprises a reservoir 20, a reclaim fluid line 21, a feed fluid line 22, a filter 23, and a pump 43. Filter 23 is coupled into feed fluid line 22 so as to remove particles from the electroless deposition solution before the electroless deposition solution enters electroless deposition chamber 12. Pump 43 is coupled into reclaim fluid line 21 so as to pump liquids from electroless deposition chamber 12 to reservoir 20. Reservoir 20 is configured to hold an electroless deposition solution. Reservoir 20 is connected with electroless deposition chamber 12 by feed fluid line 22 to provide electroless deposition solution to deposition chamber 12. Reclaim fluid line 21 is connected between electroless deposition chamber 12 and reservoir 20 to return electroless deposition solution back to reservoir 20 as a reclaim stream.

System 11 further comprises a filter system 45 integrated with reclaim fluid line 21 and disposed between reservoir 20 and electroless deposition chamber 12. Filter system 45 comprises a filter 48, a first valve 50 included on reclaim fluid line 21 between electroless deposition chamber 12 and filter 48, a second valve 52 included on reclaim fluid line 21 between reservoir 20 and filter 48, and a third valve 54 connected with reclaim fluid line 21 at a position between filter 48 and first valve 50. Filter 48 is configured to accomplish removal of particles of metal that result from electroless deposition chamber 12 and from the electroless deposition solution that is being recycled back to reservoir 20. More specifically, the filter element of filter 48 has one or more properties to allow removal of small particles such as particles of metal before the metal particles enter reservoir 20.

According to one or more embodiments of the present invention, filter system 45 further comprises an oxygen source or connection with an oxygen source 58 and a fluid line 60 connected by way of third valve 54 to reclaim fluid line 21. Optionally, oxygen source or connection to oxygen source 58 can be used to provide oxygen to reclaim fluid line 21 to aid in dissolving particles of metal trapped by filter 48. More specifically, oxygen from oxygen source or connection to oxygen source 58 provides oxygen to increase the dissolved oxygen concentration of the electroless deposition solution at filter 48 so that particles of metal trapped by filter 48 are dissolved. As an option for one or more embodiments of the present invention, oxygen from oxygen source or connection with oxygen source 58 may be provided at a higher concentration than the desired level in reservoir 20 so as to more easily dissolve particles trapped at filter 48. In other words, concentrations of oxygen higher than the desired or the effective concentrations suitable for the electroless deposition solution in reservoir 20 can be provided to the electroless deposition solution at filter 48 so as to facilitate dissolving particles trapped at filter 48.

As an option for one or more embodiments of the present invention, system 11 has reclaim fluid line 21 configured to include a U-shaped section wherein filter 48 is disposed proximate the bottom of the U-shaped fluid section so that trapped liquid at the bottom of the U-shaped section wets filter 48. More specifically, electroless deposition solution or other liquids trapped at the bottom of the U-shaped section aids in preventing filter 48 from drying. According to one or more embodiments of the present invention, filter 48 is disposed in a vertical position sufficiently low in altitude with respect to adjacent sections of reclaim fluid line 21 so that liquid is trapped at filter 48 by reclaim fluid line 21. According to one or more embodiments of the present invention, reclaim fluid line 21 is configured so as to retain some liquid at filter 48 substantially all the time.

According to one embodiment of the present invention, system 11 is configured so that during the pumping of the reclaimed electroless deposition solution, third valve 54 is closed, first valve 50 is open and second valve 52 is open so that electroless deposition liquid that is being recycled to reservoir 20 is filtered by filter 48 prior to reaching reservoir 20. After the reclaiming pump is stopped, first valve 50 and second valve 52 are closed so that residual liquid in reclaim fluid line 21 between first valve 50 and second valve 52 is trapped and keeps filter 48 wet. Also, valve 54 is opened to introduce oxygen so as to produce a higher dissolved oxygen concentration to dissolve metal particles trapped at filter 48.

A variety of configurations are suitable for oxygen source or connection to oxygen source 58 to provide oxygen for dissolving particles of metal trapped by filter 48. As one option, oxygen gas or a gas mixture containing oxygen can be provided to fluid line 21 by way of fluid line 60 and third valve 54. Alternatively, an oxygen containing compound, any compound that provides dissolved oxygen, or any compound that oxidizes the metal without significantly altering the composition of the electroless deposition solution with other components can be used.

As an option for one or more embodiments of the present invention, oxygen source or connection to oxygen source 58 may be connected with reservoir 20 so that electroless deposition solution from reservoir 20 can be circulated to filter 48 and back to reservoir 20.

According to another embodiment of the present invention, system 11 described above has valve 54 configured as a check valve. Also for this configuration, valve 52 is eliminated and valve 50 becomes optional and may or may not be included in this embodiment. Valve 54 configured as a check valve is preferably disposed proximate filter 48. Valve 54, configured as a check valve, provides a substantially continuous contact between the oxygen gas and the solution trapped at filter 48, to enrich the oxygen concentration of the electroless deposition solution flowing through filter 48 so as to dissolve metal particles trapped at filter 48. A check valve is typically configured to allow flow in substantially only one direction. According to this configuration, oxygen source 58 is maintained a pressure below the pressure in electroless deposition chamber 12 and below the pressure in reservoir 20 so that flow from oxygen source 58 is constrained by valve 54 configured as a check valve.

Figure 5:
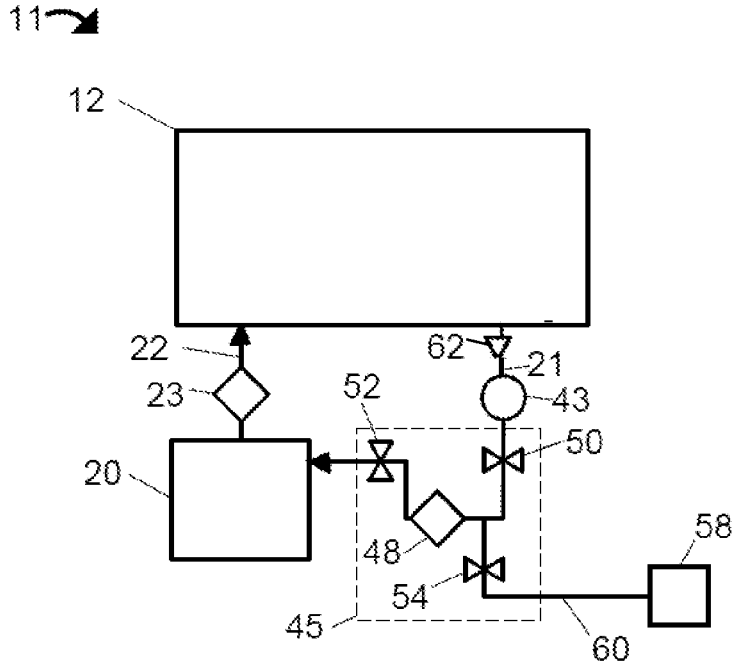
FIG. 5 is a diagram of a system according to an embodiment of the present invention.

Reference is now made to FIG. 5 where there is shown a diagram of a system 11 according to one embodiment of the present invention. System 11 shown in FIG. 5 is essentially the same as system 11 shown in FIG. 4 having all of the same elements with one exception of further comprising a liquid sensor 62 to detect the presence of liquid in electroless deposition chamber 12. Liquid sensor 62 is disposed proximate the connection of reclaim fluid line 21 to electroless deposition chamber 12. Liquid sensor 62 is connected with pump 43 so that pump operation stops when liquid sensor 62 stops detecting liquid at the bottom of electroless deposition chamber 12. Another exception for system 11 shown in FIG. 5 is the pumping speed of pump 43, the response time for liquid sensor 62, and the volume of liquid held in reclaim fluid line 21 between filter element 48 and liquid sensor 62, including integrated components, are selected so that liquid remains at filter 48 when pump 43 is stopped such as by a signal from liquid sensor 62.

Figure 6:
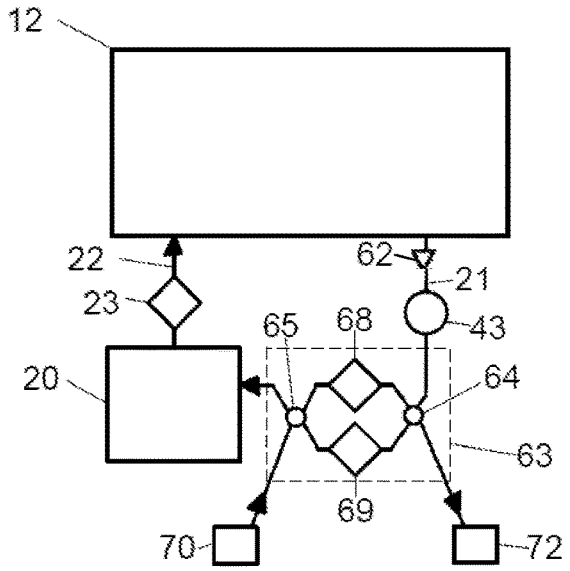
FIG. 6 is a diagram of a system according to an embodiment of the present invention.

Reference is now made to FIG. 6 where there is shown a diagram of a system 11 according to one embodiment of the present invention. System 11 comprises an electroless deposition chamber 12 to hold a substrate (substrate not shown) for electroless deposition. System 11 comprises a reservoir 20, a reclaim fluid line 21, a feed fluid line 22, a filter 23, and a pump 43. Filter 23 is coupled into feed fluid line 22 so as to remove particles from the electroless deposition solution before the electroless deposition solution enters electroless deposition chamber 12. Pump 43 is coupled into reclaim fluid line 21 so as to pump liquids from electroless deposition chamber 12 to reservoir 20. Reservoir 20 is configured to hold an electroless deposition solution. Reservoir 20 is connected with electroless deposition chamber 12 by feed fluid line 22 to provide electroless deposition solution to deposition chamber 12. Reclaim fluid line 21 is connected between electroless deposition chamber 12 and reservoir 20 to return electroless deposition solution back to reservoir 20 as a reclaim stream.

System 11 comprises a filter system 63 coupled into reclaim fluid line 21 so as to filter the electroless deposition solution to remove particles of metal. Filter system 63 comprises a first filter 68, a second filter 69, one or more valves 64, and one or more valves 65. First filter 68 is coupled into reclaim fluid line 21 so as to form a first fluid flow channel so as to filter electroless deposition fluid flow. Second filter 69 is coupled into reclaim fluid line 21 to form a second fluid flow channel so as to filter electroless deposition fluid flow. One or more valves 64 and one or more valves 65 are coupled to reclaim fluid line 21 so that reclaimed electroless deposition solution can flow back to reservoir 20 through the first fluid flow channel and first filter 68 or through the second fluid flow channel and second filter 69. More specifically, recycled electroless deposition solution can be selectively directed through first filter 68 or through second filter 69. As an option, system 11 can be operated with electroless deposition solution recycled through first filter 68 while second filter 69 is being replaced or cleaned. Alternatively, system 11 can be operated with electroless deposition solution recycled through second filter 69 while first filter 68 is being replaced or cleaned.

According to one embodiment of the present invention, first filter 68 and second filter 69 are disposed at substantially the same height. In other words, first filter 68 and second filter 69 are side-by-side at the same height. According to one or more embodiments of the present invention reclaim fluid line 21 is configured to trap electroless deposition solution so as to substantially keep first filter 68 wet and to substantially keep second filter 69 wet.

According to one or more embodiments of the present invention, system 11 further comprises a connection 70 to a source of cleaning chemicals and a connection to a drain 72. According to one embodiment, connection 70 is coupled to one or more valves 65 of filter system 63 and drain 72 is coupled to one or more valves 64 of filter system 63. One or more valves 64 and one or more valves 65 are configured to alternately direct the cleaning liquid to first filter 68 then to drain 72 to clean first filter 68 after a period of operation or to direct the cleaning liquid to second filter 69 then to drain 72 to clean second filter 69 after a period of operation. Optionally drain 72 may comprise a drain line or a line leading to a drain. In view of the present disclosure, persons of ordinary skill in the art will realize alternative configurations and connections for alternately cleaning and using the filters.

Furthermore, the one or more valves 64 and the one or more valves 65 may have a variety of configurations. For example, two four-way valves may be used to accomplish the flow switching for filter system 63. Alternatively, four three-way valves may be used to accomplish the flow switching for filter system 63. Other valve configurations will be clear to persons of ordinary skill in the art in view of the present disclosure.

According to one or more embodiments of the present invention, system 11 shown in FIG. 6 further comprises a liquid sensor 62 to detect the presence of liquid in electroless deposition chamber 12. Liquid sensor 62 is disposed proximate the connection of reclaim fluid line 21 to electroless deposition chamber 12. Liquid sensor 62 is connected with pump 43 so that pump operation stops when liquid sensor 62 stops detecting liquid in electroless deposition chamber 12. Preferably, the pumping speed of pump 43, the response time for liquid sensor 62, and the volume of liquid held in reclaim fluid line 21 between first filter 68 and liquid sensor 62, including integrated components, are selected so that liquid remains at first filter 68 when pump 43 is stopped such as by a signal from liquid sensor 62 when first filter 68 is being used for filtering the electroless deposition solution being recycled to reservoir 20. Similarly, the pumping speed of pump 43, the response time for liquid sensor 62, and the volume of liquid held in reclaim fluid line 21 between second filter 69 and liquid sensor 62, including integrated components, are selected so that liquid remains at second filter 69 when pump 43 is stopped such as by a signal from liquid sensor 62 when second filter 69 is being used for filtering the electroless deposition solution being recycled to reservoir 20.

As an option for one or more embodiments of the present invention, system 11 may further comprise a connection to an oxygen source (not shown in FIG. 6) coupled reclaim fluid line 21 to provide oxygen to the electroless deposition solution in the reclaim line.

Figure 7:
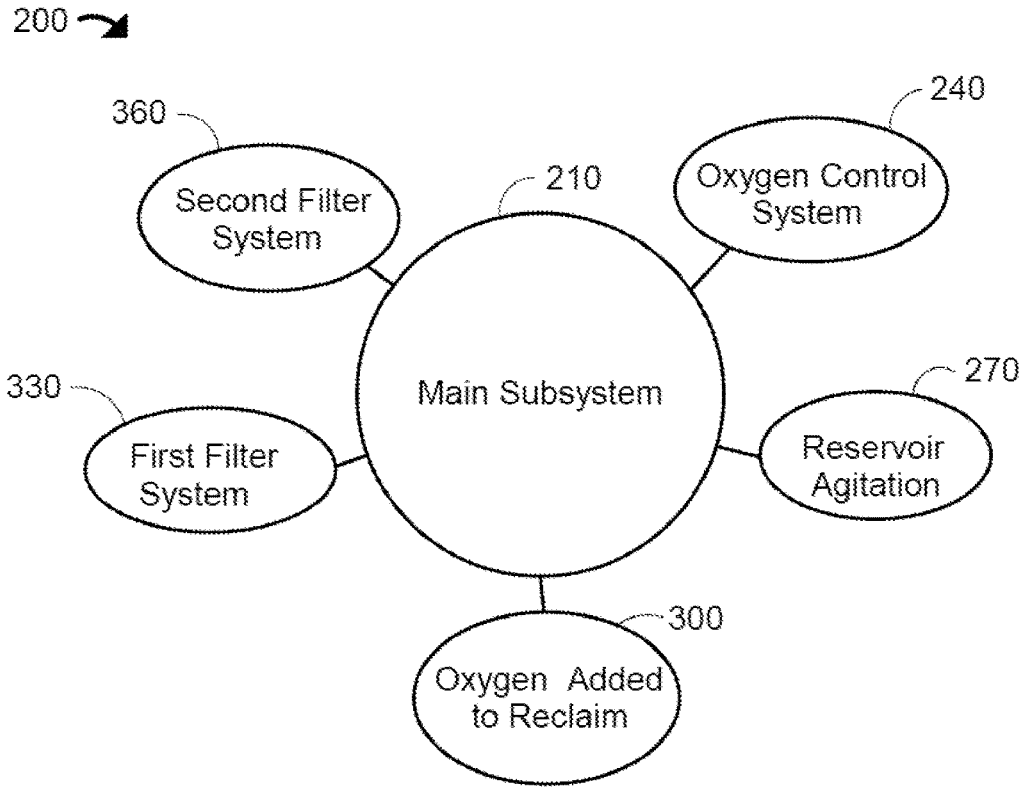
FIG. 7 is a diagram of a system according to an embodiment of the present invention.

Reference is now made to FIG. 7 where there is shown a system 200 for electroless deposition according to one or more embodiments of the present invention. System 200 comprises a main subsystem 210, and a subsystem 240, a subsystem 270, a subsystem 300, a subsystem 330, and a subsystem 360. Embodiments of the present invention include main system 210 and two or more of the subsystems combined for applications such as electroless deposition of metal on a substrate.

According to one embodiment of the present invention, main subsystem 210 comprises an electroless deposition chamber to hold the substrate for electroless deposition, a reservoir to hold an electroless deposition solution, an input line between the electroless deposition chamber and the reservoir to provide electroless deposition solution from the reservoir to the electroless deposition chamber, and a reclaim line between the electroless deposition chamber and the reservoir to recycle electroless deposition solution from the electroless deposition chamber back to the reservoir. The components of main subsystem 210 are described in more detail in FIGS. 1 through 6 and the associated description of FIGS. 1 through 6 provided above.

Subsystem 240 comprises a sensor responsive to dissolved oxygen, the sensor is disposed so as to measure the dissolved oxygen concentration of the electroless deposition solution in the input line; an oxygen source coupled to the reservoir; a controller connected with the oxygen source and connected with the sensor so as to adjust the concentration of dissolved oxygen of the electroless deposition solution in response to signals from the sensor. The components of subsystem 240 are described in more detail in FIG. 1 and the associated description of FIG. 1 provided above.

Subsystem 270 comprises an agitator for liquids coupled with the reservoir so as to accomplish mixing of the electroless deposition solution in the reservoir. The components of subsystem 270 are described in more detail in FIG. 2 and the associated description of FIG. 2 provided above.

Subsystem 300 comprises a connection to an oxygen source coupled to the reclaim line to provide dissolved oxygen to the electroless deposition solution in the reclaim line. The components of subsystem 300 are described in more detail in FIG. 3 and FIG. 3-1 and the associated description of FIG. 3 and FIG. 3-1 provided above.

Subsystem 330 comprises a filter system coupled into the reclaim line so as to filter the electroless deposition solution to remove particles of the metal, the filter system comprises a filter, a first valve connected between the electroless deposition chamber and the filter, a second valve connected between the reservoir and the filter, and a third valve connected between the filter and the first valve; a connection to an oxygen source to provide dissolved oxygen to the reclaim line through the third valve. The components of subsystem 330 are described in more detail in FIGS. 4 and 5 and the associated description of FIGS. 4 and 5 provided above.

Subsystem 360 comprises a second filter system coupled into the reclaim line so as to filter the electroless deposition solution to remove particles of the metal, the second filter system comprises: a first filter; a second filter; one or more valves; the first filter is coupled into the first fluid flow channel so as to filter electroless deposition fluid flow there through, the second filter is coupled into the second fluid flow channel so as to filter electroless deposition fluid flow there through, the one or more valves are coupled to the reclaim line so that reclaimed electroless deposition solution can flow to the reservoir through the first fluid flow channel and the first filter or through the second fluid flow channel and the second filter. The components of subsystem 360 are described in more detail in FIG. 6 and the associated description of FIG. 6 provided above.

As an option, one or more embodiments of the present invention may include additional components (additional components not shown in the figures) that may be typical in electroless deposition systems. Descriptions of additional components such as one or more heaters coupled to control the temperature of the electroless deposition solution and such as one or more additional pumps for pumping the electroless deposition solution can be found in commonly owned U.S. Pat. Nos. 6,846,519, 7,845,308, and 8,069,813, the contents of these patents are incorporated in their entirety by this reference for all purposes.

A variety of electroless deposition solutions can be used for one or more embodiments of the present invention. Examples of electroless deposition solutions for one or more embodiments of the present invention include, but are not limited to, electroless deposition solutions presented in commonly owned U.S. Pat. No. 6,911,067 and electroless deposition solutions presented in scientific and/or patent literature. According to one embodiment of the present invention, the electroless deposition solution is configured for electroless deposition of cobalt and/or cobalt alloys.

According to one or more other embodiments of the present invention, electroless deposition solution is configured for electroless deposition of other metals or metal alloys suitable for metallization layers in electronic devices.

According to one or more embodiments of the present invention, the method includes using a substrate that has been activated for electroless deposition. More specifically, the substrate has been prepared so that it is susceptible to electroless deposition. Alternatively, one or more embodiments of the present invention comprise using a substrate that has electrically conductive areas that are capable of initiating electroless deposition. In other words, one or more embodiments of the present invention includes using an electroless deposition solution configured to electrolessly deposit a metal on an activated surface or on an electrically conductive surface of a substrate. Optionally, the substrate may be a substrate such as a semiconductor wafer such as a silicon wafer or a substrate of another material suitable for fabricating electronic devices.

One embodiment of the present invention is a method of electroless deposition. The method comprises recycling at least a portion of electroless deposition solution. The method further includes oxygenating the recycled electroless deposition solution prior to returning the electroless deposition solution to a reservoir. According to one or more embodiments of the present invention, the electroless deposition solution is oxygenated to achieve an effective amount of dissolved oxygen in the electroless deposition solution to dissolve any deposited particles and thus to inhibit plating out. According to one or more embodiments of the present invention the effective amount of dissolved oxygen is at or above the level in equilibrium with 0.5% oxygen gas in a gas mixture atop the deposition solution at one atmosphere.

According to one or more other embodiments of the present invention, the effective amount of dissolved oxygen in the electroless deposition solution may be other than at the level in equilibrium with 0.5% of oxygen gas in a gas mixture at one atmosphere in contact with the deposition solution. The amount of dissolved oxygen required to inhibit plating out is affected by factors such as the type of metal being deposited, the composition of the electroless deposition solution, the temperature of the electroless deposition solution, the feature sizes of the devices to be plated, and even where the oxygen source is connected to the electroless deposition system. Persons of ordinary skill in the art, in view of the present disclosure, will be able to determine the effective amount of dissolved oxygen without undue experimentation.

One or more embodiments of the present invention, includes a method performed using a system that includes an electroless deposition chamber to hold a substrate for electroless deposition, a reservoir, a reclaim fluid line, a feed fluid line, a filter, and a pump. The filter is coupled into the feed fluid line so as to remove particles from the electroless deposition solution before the electroless deposition solution enters the electroless deposition chamber. The pump is coupled into the reclaim fluid line so as to pump liquids from the electroless deposition chamber to the reservoir. The reservoir is configured to hold an electroless deposition solution. The reservoir is connected with the electroless deposition chamber by the feed fluid line to provide electroless deposition solution to the deposition chamber. The reclaim fluid line is connected between the electroless deposition chamber and the reservoir to return electroless deposition solution back to the reservoir as a reclaim stream. The method comprises one or more of the processes:

maintaining an effective concentration of dissolved oxygen in the electroless deposition solution present in the reservoir by adjusting oxygen input to the reservoir in response to measurements of dissolved oxygen concentration of the electroless deposition solution in the fluid feed line;

maintaining an effective concentration of dissolved oxygen in the reclaim fluid line so as to inhibit plating out and/or to dissolve metal particles;

mixing the electroless deposition solution in the reservoir sufficiently so as to maintain a dissolved oxygen concentration level throughout the reservoir sufficient to inhibit plating out and/or to dissolve metal particles; and filtering metal particles from recycled electroless deposition solution prior to returning the electroless deposition solution to the reservoir and dissolving the metal particles.

According to one or more embodiments of the present invention, the maintaining an effective concentration of dissolved oxygen in the electroless deposition solution to inhibit plating out the metal is accomplished in a reservoir by controlling the oxygen concentration. Optionally, the oxygen concentration in the electroless deposition solution may be controlled using an automatic controller using a control scheme such as feedback control, such as proportional control, such as integral control, such as derivative control, and/or combinations thereof. According to one or more embodiments of the present invention, the maintaining an effective concentration of dissolved oxygen in the electroless deposition solution to prevent plating out the metal is accomplished in a reservoir by controlling the oxygen concentration to the level in equilibrium with 0.5% of oxygen gas in a gas mixture above the electroless deposition solution at one atmosphere pressure.

According to one or more embodiments of the present invention, the maintaining an effective concentration of dissolved oxygen in the electroless deposition solution to inhibit plating out the metal is accomplished in a reservoir by stirring the solution sufficiently to prevent oxygen concentration gradients in the solution. As an option for one or more embodiments of the present invention, the maintaining an effective concentration of dissolved oxygen in the solution to prevent plating out the metal is accomplished in a reservoir by stirring the solution so that the oxygen concentration is uniform at a desired level throughout the solution. In other words, for one or more embodiments of the present invention, the process includes sufficiently mixing electroless deposition solution in the reservoir so as to substantially prevent oxygen concentration gradients were the oxygen concentration is below the level in equilibrium with 0.5% oxygen gas in a gas mixture above the deposition solution at one atmosphere pressure.

According to one or more embodiments of the present invention, the maintaining an effective concentration of dissolved oxygen in a cobalt electroless deposition solution to inhibit plating out of cobalt particles is accomplished in a reservoir by stirring the solution sufficiently to prevent oxygen concentration gradients in the solution. As an option for one or more embodiments of the present invention, the maintaining an effective concentration of dissolved oxygen in the solution to inhibit plating out of cobalt particles is accomplished in a reservoir by stirring the solution so that the oxygen concentration throughout the solution is uniformly at the level in equilibrium with 0.5% oxygen gas in a gas mixture above the deposition solution at one atmosphere pressure. In other words, for one or more embodiments of the present invention, the process includes sufficiently mixing electroless deposition solution in the reservoir so as to substantially prevent oxygen concentration gradients where the oxygen concentration is below an effective level.

According to one or more embodiments of the present invention, the maintaining an effective concentration of dissolved oxygen in the cobalt electroless deposition solution to inhibit plating out of particles of the cobalt is accomplished in a reservoir by controlling the oxygen concentration. Optionally, the oxygen concentration in the cobalt electroless deposition solution may be controlled using an automatic controller using a control scheme such as feedback control, such as proportional control, such as integrative control, such as derivative control, and/or combinations thereof. According to one or more embodiments of the present invention, the maintaining an effective concentration of dissolved oxygen in the cobalt electroless deposition solution to prevent plating out of particles of the cobalt is accomplished in a reservoir by controlling the oxygen concentration to the level in equilibrium with 0.5% oxygen gas in a gas mixture above the deposition solution at one atmosphere pressure.

According to one or more embodiments of the present invention, the maintaining an effective concentration of dissolved oxygen in the cobalt electroless deposition solution to inhibit plating out of particles of the cobalt is accomplished in a reservoir by adding oxygen to the reservoir. As an option for one or more embodiments of the present invention, the maintaining an effective concentration of dissolved oxygen in the solution to prevent plating out of particles of the metal is accomplished in a reservoir by controlling the oxygen concentration to the level in equilibrium with 0.5% oxygen gas in a gas mixture atop the deposition solution at one atmosphere pressure in response to measurements of the dissolved oxygen concentration.

Additional details of exemplary electroless deposition systems and apparatuses can be found in commonly owned patents U.S. Pat. Nos. 7,845,308 and 6,846,519. The contents of these patents are incorporated herein by this reference, in their entirety, for all purposes.

In the foregoing specification, the invention has been described with reference to specific embodiments. However, one of ordinary skill in the art appreciates that various modifications and changes can be made without departing from the scope of the present invention as set forth in the claims below. Accordingly, the specification is to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A system for electroless deposition of metal on a substrate comprising:

an electroless deposition chamber to hold the substrate for electroless deposition;

a reservoir to hold an electroless deposition solution; said electroless deposition solution has a dissolved oxygen concentration and is configured for electroless deposition of metal;

an input line between the electroless deposition chamber and the reservoir to provide the electroless deposition solution from the reservoir to the electroless deposition chamber;

a filter coupled into the input line to remove particles from the electroless deposition solution before the electroless depositon solution enters the electroless deposition chamber;

a reclaim line between the electroless deposition chamber and the reservoir to recycle electroless deposition solution from the electroless deposition chamber back to the reservoir;

a filter system coupled into the reclaim line so as to filter the electroless deposition solution to remove particles of metal, the filter system located directly in the reclaim line between the electroless deposition chamber and the reservoir; said filter system consisting essentially of filter element, a first vavle connected between the electroless deposition chamber and the filter element, a second valve connected between the reservoir and the filter element, and a third valve connected between the filter element and the first valve; and a connection to an oxygen source to provide dissolved oxygen to the reclaim line through the third valve, wherein the dissolved oxygen is directly supplied to the reclaim line leading into the filter element and the third valve is configured to produce a higher dissolved oxygen concentration in the electroless deposition solution to dissolved metal particles trapped at the filter element.

2. The system of claim 1, wherein the filter system has a U-shaped fluid conduit connecting the first valve, the second valve, and the third valve; the filter being disposed proximate the bottom of the U-shaped fluid conduit so as to trap liquid at the bottom of the U-shaped fluid conduit so as to wet the filter.

3. The system of claim 1, wherein the connection to the oxygen source to provide dissolved oxygen to the reclaim line through the third valve comprises a connection to the filter system so as to provide the electroless deposition solution with the dissolved oxygen concentration higher than a level of the dissolved oxygen concentration in equilibrium with a gas mixture above the electroless deposition solution at one atmosphere pressure where said gas mixture is 0.5% oxygen gas.

4. The system of claim 1, comprising:

a liquid sensor to detect the presence of liquid in the electroless deposition chamber, the liquid sensor disposed proximate the connection of the reclaim line to the electroless deposition chamber;

the filter system coupled into the reclaim line, the filter system comprising a filter element;

a pump coupled into the reclaim line so as to move liquids from the electroless deposition chamber through the reclaim line, the pump being disposed between the filter element and the liquid sensor;

the reclaim line being formed so as to trap liquid at the filter element;

the liquid sensor being connected with the pump so that pump operation stops when the liquid sensor stops detecting liquid in the electroless deposition chamber.

* * * * *